US005245906A

United States Patent [19]

Muller et al.

[11] Patent Number: 5,245,906

[45] Date of Patent: Sep. 21, 1993

[54] APPARATUS FOR INFEEDING CARTRIDGES OF TWO DIFFERENT TYPES OF AMMUNITION TO A GATLING-TYPE GUN

[75] Inventors: Kurt Muller, Zurich; Jurg Dunki, Dietikon, both of Switzerland

[73] Assignee: Oerlikon-Contraves AG, Zurich, Switzerland

[21] Appl. No.: 913,197

[22] Filed: Jul. 14, 1992

[30] Foreign Application Priority Data

Jul. 30, 1991 [CH] Switzerland ..... 02278/91

[51] Int. Cl.[5] ..... F41A 9/04; F41A 9/37

[52] U.S. Cl. ..... 89/33.04; 89/33.16; 89/33.4

[58] Field of Search ..... 89/12, 33.04, 33.16, 89/33.25, 33.4

[56] References Cited

U.S. PATENT DOCUMENTS 4,434,699 3/1984 Tassie ..... 89/12
4,494,440 1/1985 Koine ..... 89/33.04
5,115,713 5/1992 Muller et al. ..... 89/33.16

FOREIGN PATENT DOCUMENTS 0020095 12/1980 European Pat. Off. .
0403776 12/1990 European Pat. Off. .
3202841 8/1982 Fed. Rep. of Germany .

OTHER PUBLICATIONS

German Search Report and Annex.

*Primary Examiner*—Stephen C. Bentley
*Attorney, Agent, or Firm*—Sandler Greenblum & Bernstein

[57] ABSTRACT

Apparatuses for the infeed of cartridges predominantly of two different types of ammunition to a Gatling-type gun or weapon system, can be stationarily installed if there are employed, apart from two transport devices, storage devices for the intermediate storage of the empty cases or spent cartridges during the reverse clearing operation following a firing burst. There is prevented transport of empty cases or spent cartridges during reverse clearing by the Gatling-type gun and there is attained the result that the Gatling-type gun is free of empty cases prior to accomplishing a new firing burst. Additionally, it is possible to fire cartridges or ammunition rounds of one type of ammunition without interruption from two ammunition magazines.

3 Claims, 9 Drawing Sheets

FIG. 4a
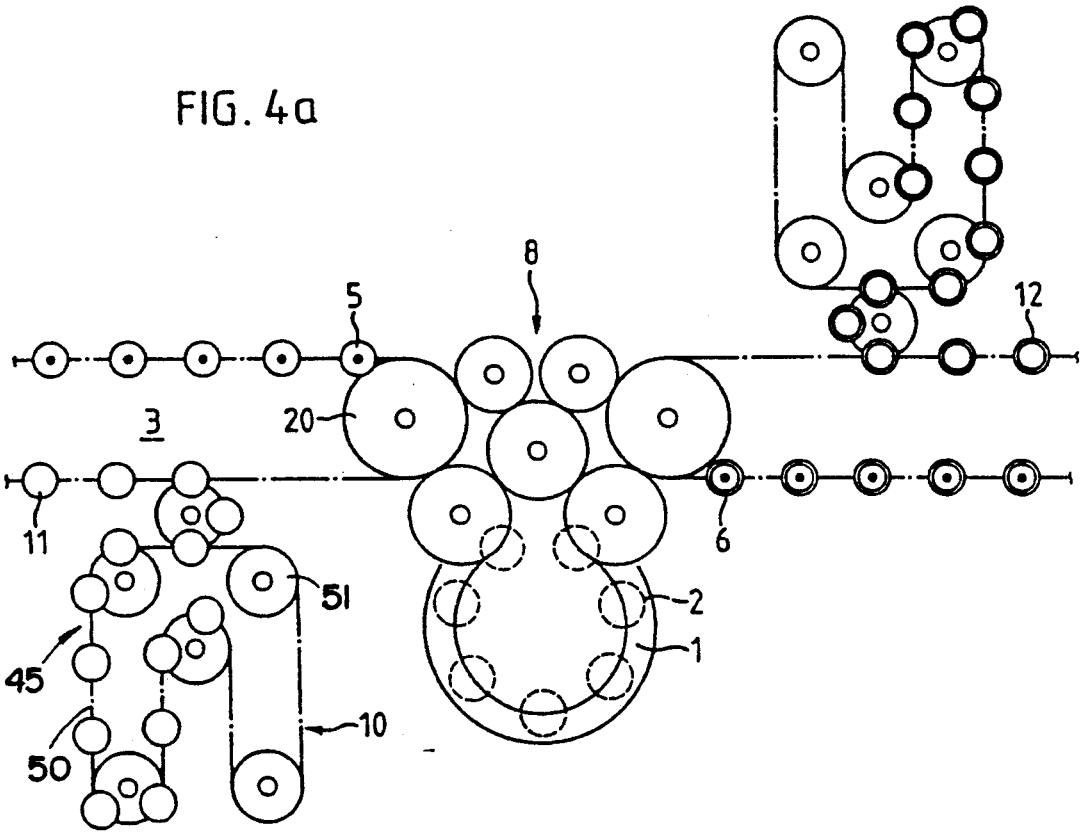
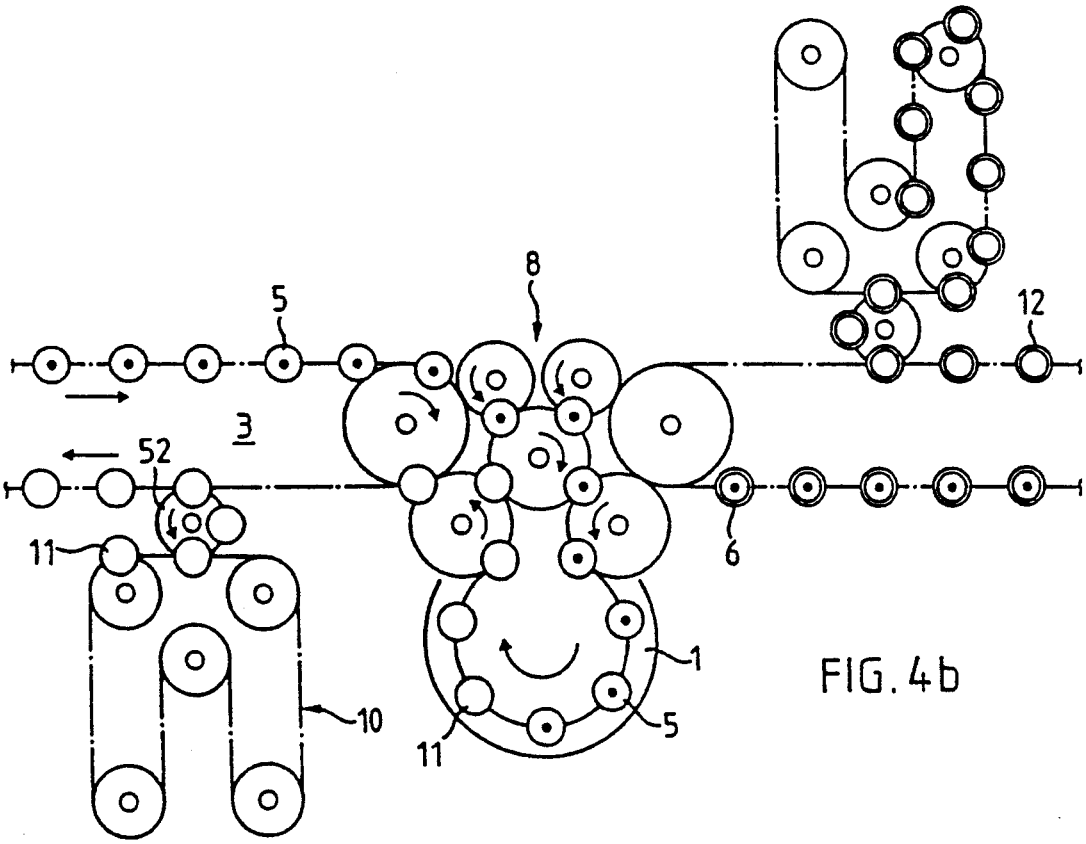
FIG. 4b

FIG. 4c
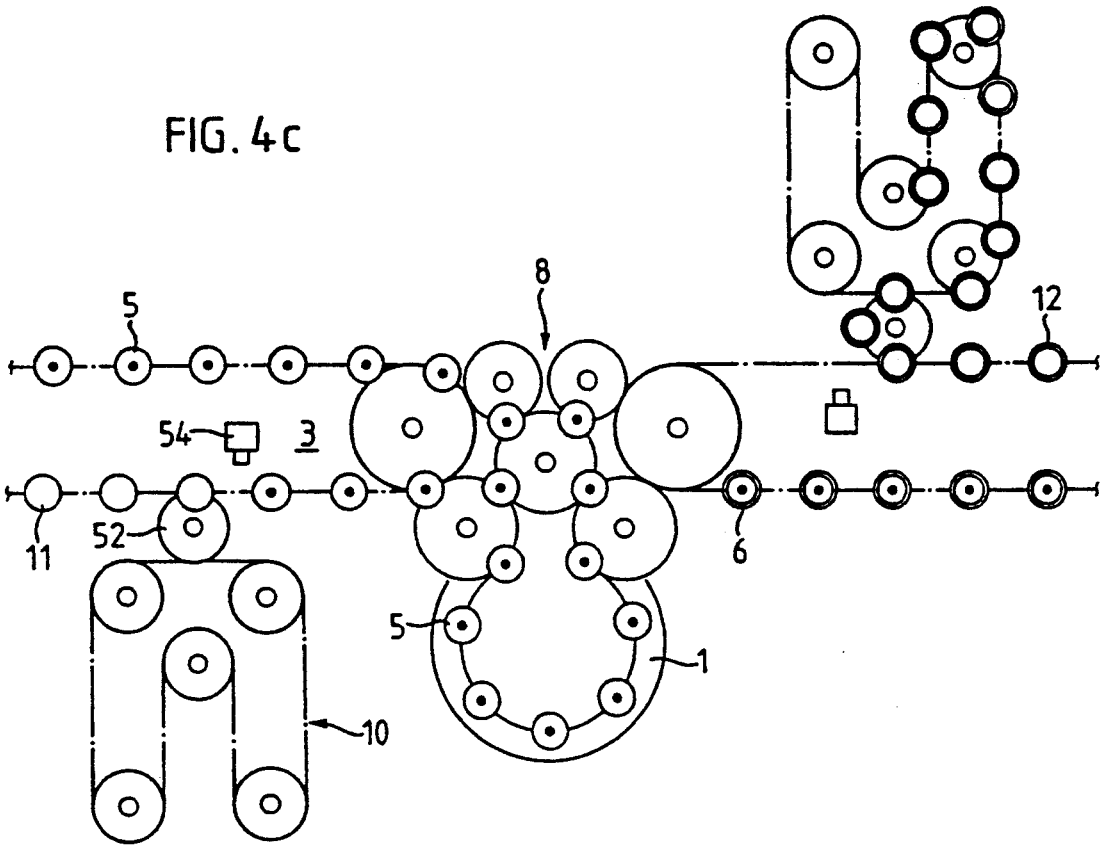
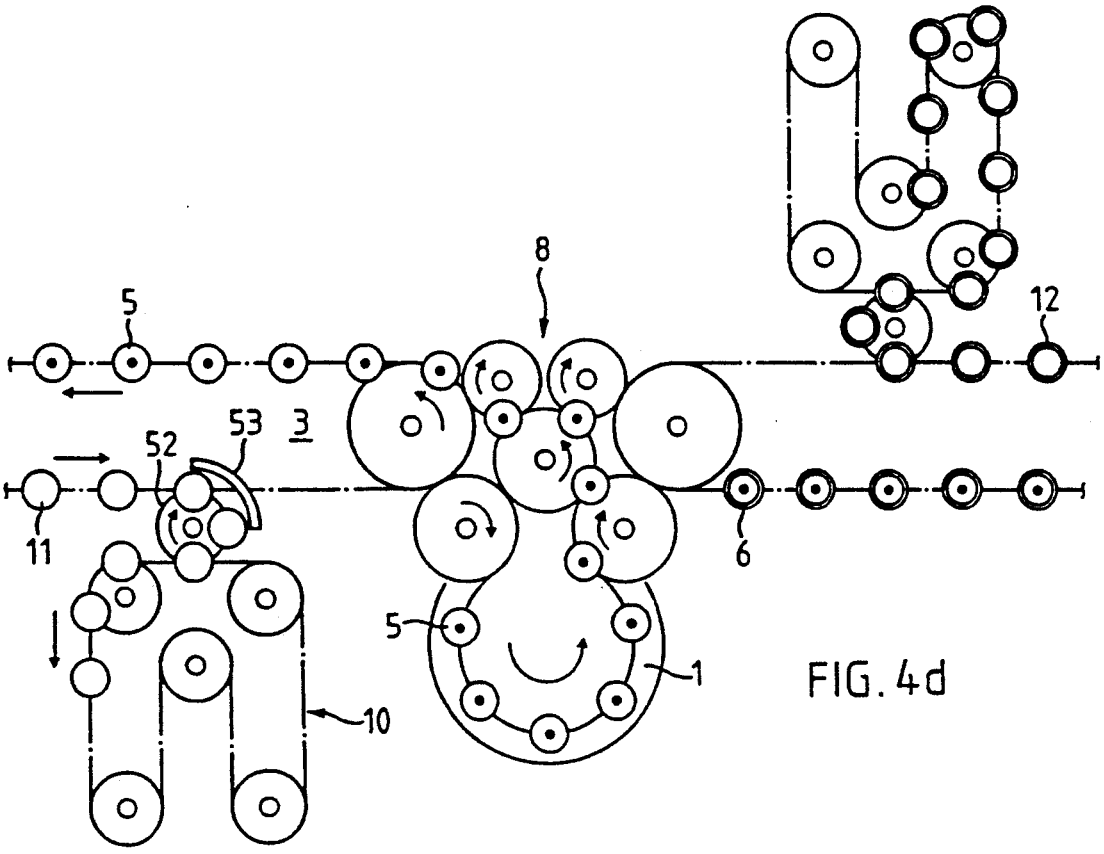
FIG. 4d

APPARATUS FOR INFEEDING CARTRIDGES OF TWO DIFFERENT TYPES OF AMMUNITION TO A GATLING-TYPE GUN

CROSS REFERENCE TO RELATED APPLICATION

This application is related to the commonly assigned, copending U.S. application Ser. No. 07/921,043, filed Jul. 28, 1992 and entitled "Apparatus For Infeeding Cartridges of Two Different Types of Ammunition to a Gatling-Type Gun", to which reference may be readily had and the disclosure of which is incorporated herein in its entirety by reference.

BACKGROUND OF THE INVENTION

1. Field of the Invention

The present invention relates to a new and improved apparatus for the infeed or feed of cartridges predominantly or generally composed of two different types of ammunition to a Gatling-type gun or weapon system.

Generally speaking, the inventive apparatus for the infeed of cartridges or ammunition rounds predominantly or generally composed of two different types of ammunition to a Gatling-type gun or weapon system is of the type comprising a first transport device and a second transport device for the transport of cartridges and empty cases or spent cartridges predominantly or generally composed of a respective type of ammunition. A third device is arranged between the first transport device and the second transport device and in coacting relation with the Gatling-type gun for infeeding the cartridges of one ammunition type or the other ammunition type to the Gatling-type gun. A coupling device operatively couples or associates the first transport device or the second transport device with the third device.

2. Discussion of the Backqround and Material Information

With an ammunition infeeding apparatus of the aforementioned type, hereinafter also conveniently referred to as a double or twin ammunition infeeding apparatus, such apparatus is of the type wherein two different types of ammunition can be selectively delivered to a Gatling-type gun or weapon system. As a result, it is possible to change the type of ammunition or rounds which are to be fired between the firing bursts or surges.

Double or twin ammunition infeeding apparatuses of the aforementioned type are known, for example, from U.S. Pat. No. 4,434,699, granted March 6, 1984 and the cognate German Patent No. 3,040,798, dated September 3, 1981. In such apparatus two endless transport devices, which serve for the infeed of ammunition, are displaceably arranged in relation to a third device. If there is switched over from one type of ammunition to another type of ammunition, then both of the endless transport devices are mechanically shifted, and in each case a gear of one of the endless transport devices meshes with a gear of the third device. Since there is provided a drive source which not only drives the Gatling-type gun but also the third device, with this solution there is also selectively also conjointly driven one or the other of the endless transport devices, and thus, there is delivered the one or the other type of ammunition to the Gatling-type gun. However, following repositioning after a firing burst with one type of ammunition, empty cases or spent cartridges remain both in the Gatling-type gun and also in the third device. During the next firing burst with the other type of ammunition, the remaining empty cases or spent cartridges in the Gatling-type gun and in the third device arrive at the other endless transport device.

In the context of this disclosure, the term "reverse clearing" or "repositioning" means the return movement of the Gatling-type gun, the third device and the endless transport device, in order to re-establish a preparatory firing state or condition. During the reverse clearing or repositioning operation the cartridges are transported in the opposite direction by the Gatling-type gun, the third device and the endless transport device, however are not fired.

A further proposal is known to the art from German Published Patent Application No. 3,202,841, published August 19, 1982. Also in this document there is disclosed a Gatling-type gun provided with an infeed apparatus for the infeed of two different types of ammunition. This ammunition infeed apparatus possesses two endless stationary transport devices for the infeed or delivery of two different types of ammunition and either one or the other of both endless transport devices is selectively switched-in or activated. Furthermore, a third device is provided for the reception and infeed of cartridges from and to the breechblocks. However, with this proposal empty cases or spent cartridges are not removed by means of the endless transport devices, rather by an additional channel.

Furthermore, an ammunition storage apparatus is disclosed in the commonly assigned U.S. application Serial No. 07/698,075, filed May 10, 1991, now Patent No. 5,115,713, to which reference may be readily had and the disclosure of which is incorporated herein in its entirety by reference, and the cognate European Patent Application Serial No. 91 107 190.0.

SUMMARY OF THE INVENTION

Therefore, with the foregoing in mind, it is a primary object of the present invention to provide an improved apparatus for the infeed of cartridges generally composed of two different types of ammunition to a Gatling-type gun or weapon system, which is not afflicted with the aforementioned shortcomings and drawbacks of the prior art.

Another and more specific object of the present invention aims at the provision of an ammunition infeed apparatus which simplifies the infeed of cartridges composed of two different types of ammunition to a Gatling-type gun and during reverse clearing prevents the transport of empty cases by the third device and the Gatling-type gun.

Now in order to implement these and still further objects of the present invention, which will become more readily apparent as the description proceeds, the apparatus for the infeed of cartridges predominantly or generally composed of two different types of ammunition to a Gatling-type gun or weapon system of the present development is manifested, among other things, by the features that the first transport device and the second transport device are stationarily arranged relative to the third device. A respective storage device is operatively associated with the first transport device and the second transport device for receiving or taking-up empty cases or spent cartridges from the first transport device and the second transport device during reverse clearing following a firing burst, in order to ensure that prior to a new firing burst both the Gatling-type gun and the third device are free or devoid of empty cases.

According to a further aspect of the present invention, each of the storage devices is operatively associated with a respective sensor or feeler and a respective switching gate or switch and during reverse clearing deliver the empty cases to the associated storage device.

Still further, the coupling device is constructed such that the first transport device and the second transport device are also simultaneously coupled with the third device in order to interconnect both of the first and second transport devices when there are only used cartridges of one single type of ammunition.

One of the more notable advantages of the present invention resides in the fact that the transport devices during changing over from one type to the other type of ammunition, namely, during the selective coupling with the third device and the Gatling-type gun, no longer need be moved. Consequently, the construction is simplified at the location or region of the third device.

A preferred construction of the present invention uses as the coupling device for coupling of the one or the other of the transport devices with the third device and the Gatling-type gun, couplings or coupling means which are actuated by means of switching levers. As a result, there is possible performance of a firing operation without any switching interval when there is used only one type of ammunition which is delivered from both of the ammunition magazines.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIGS. 4*a*, 4*b*, 4*c* and 4*d* depict different phases of the function of the inventive double or twin ammunition infeeding apparatus for infeeding ammunition to a Gatling-type gun during a firing burst or surge;

DETAILED DESCRIPTION OF THE PREFERRED EMBODIMENTS

Describing now the drawings, it is to be understood that only enough of the construction of the apparatus for the infeed of cartridges predominantly or generally composed of two different types of ammunition to a Gatling-type gun or weapon system has been depicted therein, in order to simplify the illustration, as needed for those skilled in the art to readily understand the underlying principles and concepts of the present invention.

Figure 1:
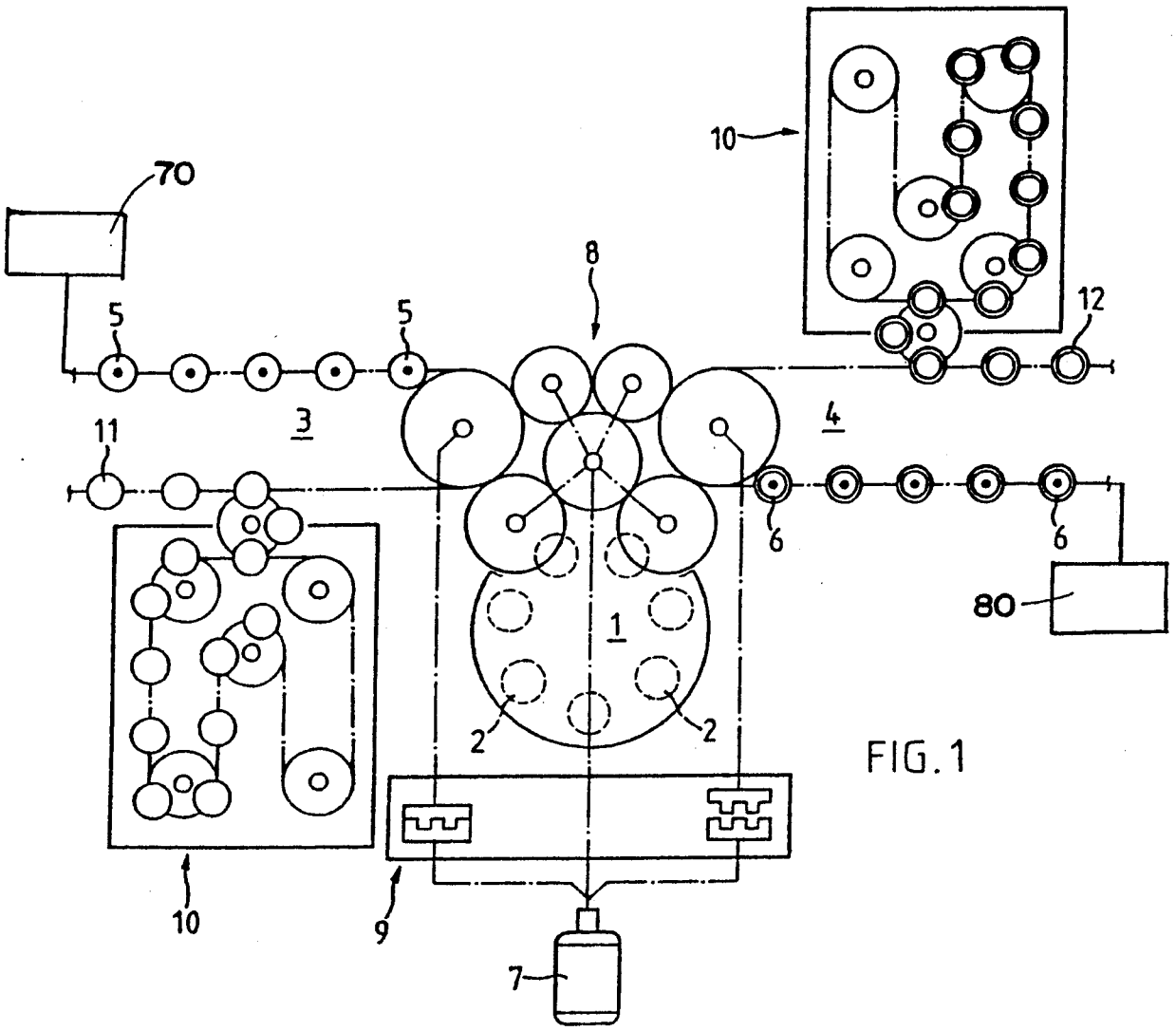
FIG. 1 is a simplified schematic illustration of an inventive double or twin, ammunition infeeding or feed apparatus for infeeding ammunition to a Gatling-type gun.

Turning attention now to FIG. 1, there is depicted therein a suitable Gatling-type gun 1 containing a number of breechblocks or breech mechanisms 2, with which there is operatively associated an apparatus for the infeed of cartridges or ammunition rounds 5 or 6 of the ammunition types A or B. As will be recalled, such ammunition infeed apparatus is also sometimes referred to herein as a double or twin ammunition infeeding apparatus. This double or twin ammunition infeeding apparatus comprises a first transport device 3 and a second transport device 4 for the transport of the cartridges or ammunition rounds 5 of ammunition type A and the cartridges or ammunition rounds 6 of ammunition type B, respectively. These first and second transport devices 3 and 4 advantageously each comprise an endless transport device.

The cartridges or ammunition rounds 5 and 6 of the ammunition type A and B are delivered or transported from the here merely schematically depicted ammunition magazines 70 and 80, respectively. Additionally, there is located between the first and second endless transport devices 3 and 4 a third device 8 for the take-up and delivery of cartridges or ammunition rounds 5 or 6 of the respective ammunition type A or B to the breechblocks 2. Still further, there is provided a suitable drive source or drive means 7 for driving the Gatling-type gun 1, the third device 8, and additionally, by means of a coupling device or coupling means 9 selectively either the first endless transport device 3 or the second endless transport device 4. Moreover, there are provided storage devices 10 serving for the reception or take-up of empty cases or spent cartridges 11 or 12 of the ammunition type A or B from the first endless transport device 3 or the second endless transport device 4 during reverse clearing or repositioning. These storage devices 10 ensure that both the Gatling-type gun 1 and also the third device 8 are devoid of empty cases or spent cartridges 11 or 12 prior to carrying out a new firing burst.

Figure 2:
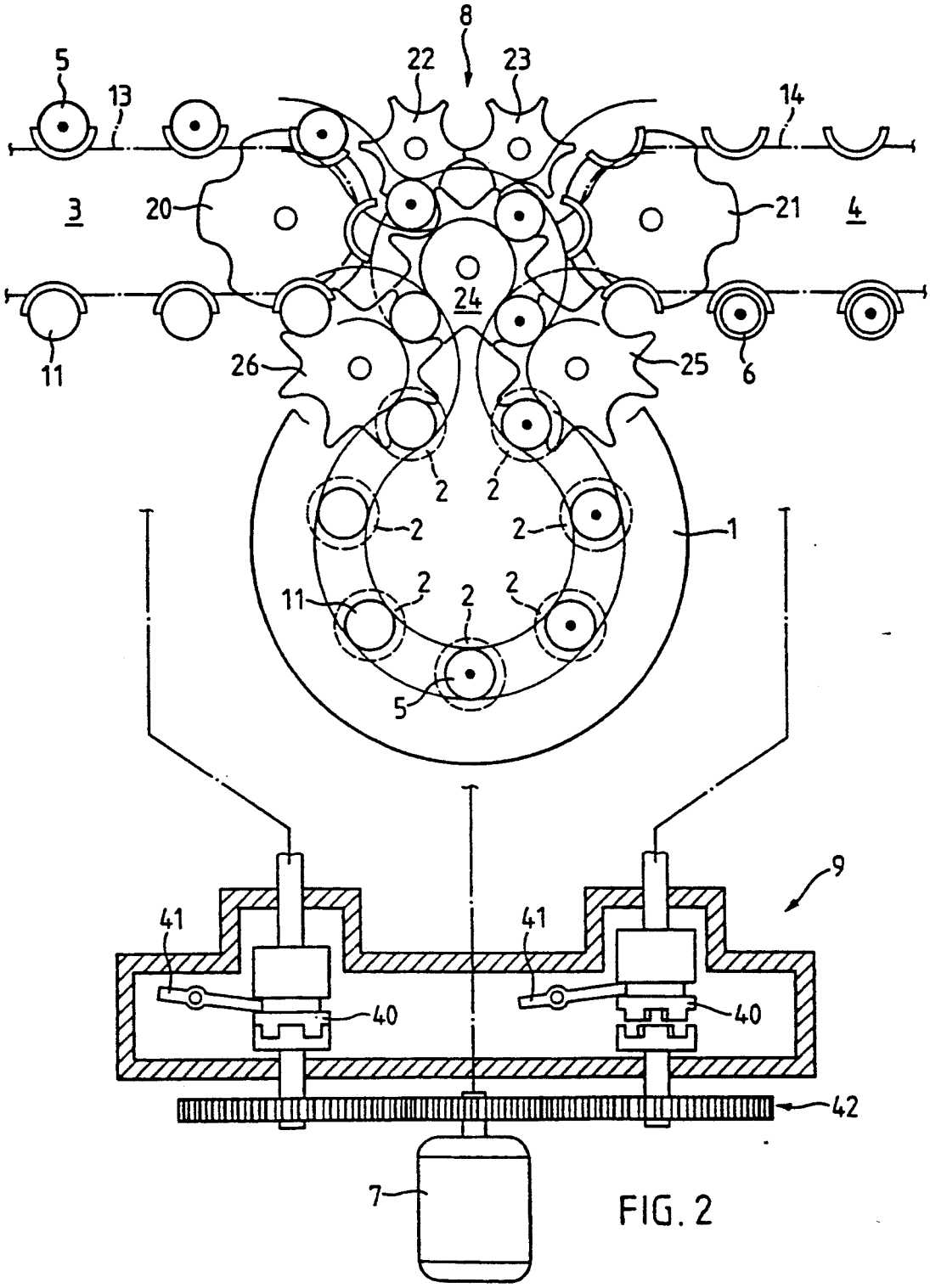
FIG. 2 is a fragmentary and enlarged detail view of part of the double or twin ammunition infeeding apparatus of FIG. 1.

FIG. 2 illustrates part of the double or twin ammunition infeeding apparatus while here assuming, solely by way of explanation and not limitation, that there are fired cartridges or ammunition rounds 5 of the ammunition type A. These cartridges 5 of the ammunition type A are infed by means of a bucket chain I3 of the first endless transport device 3 and by means of a transport wheel 20 or equivalent structure of the third device 8. In this third device 8 the cartridges 5 are transferred to a central deflection or turning wheel 24 and with the aid of deflection or turning wheels 22, 23 and 25 these cartridges 5 are further conveyed or transported to the breechblocks 2 of the Gatling-type gun 1. After firing of the cartridges or ammunition rounds 5 the empty cases or spent cartridges 11 are returned by the Gatling-type gun 1 to the third device 8. During such time as the empty cases or spent cartridges 11 are guided by the central deflection or turning wheel 24 and a deflection or turning wheel 26, these empty cases or spent cartridges are again returned by means of the transport wheel 20 and the bucket chain 13 of the first endless transport device 3.

The drive source or drive means 7 is connected by means of any suitable and thus here not further shown transmission or gearing with the Gatling-type gun 1 and the third device 8 as well as by means of a transmission or gearing 42 with the coupling device 9, so that there can be selectively coupled or connected the first endless transport device 3 and/or the second endless transport device 4. As a result, cartridges or ammunition rounds 5 or cartridges or ammunition rounds 6 of the respective ammunition type A or B can be delivered to the Gatling-type gun 1. The coupling device or means 9 comprises any suitable coupling elements or coupling structure 40 and lever means 41 or the like for actuation of the coupling elements 40. In accordance with the foregoing description there is here assumed to be operatively coupled or connected the first endless transport device 3.

Figure 7:
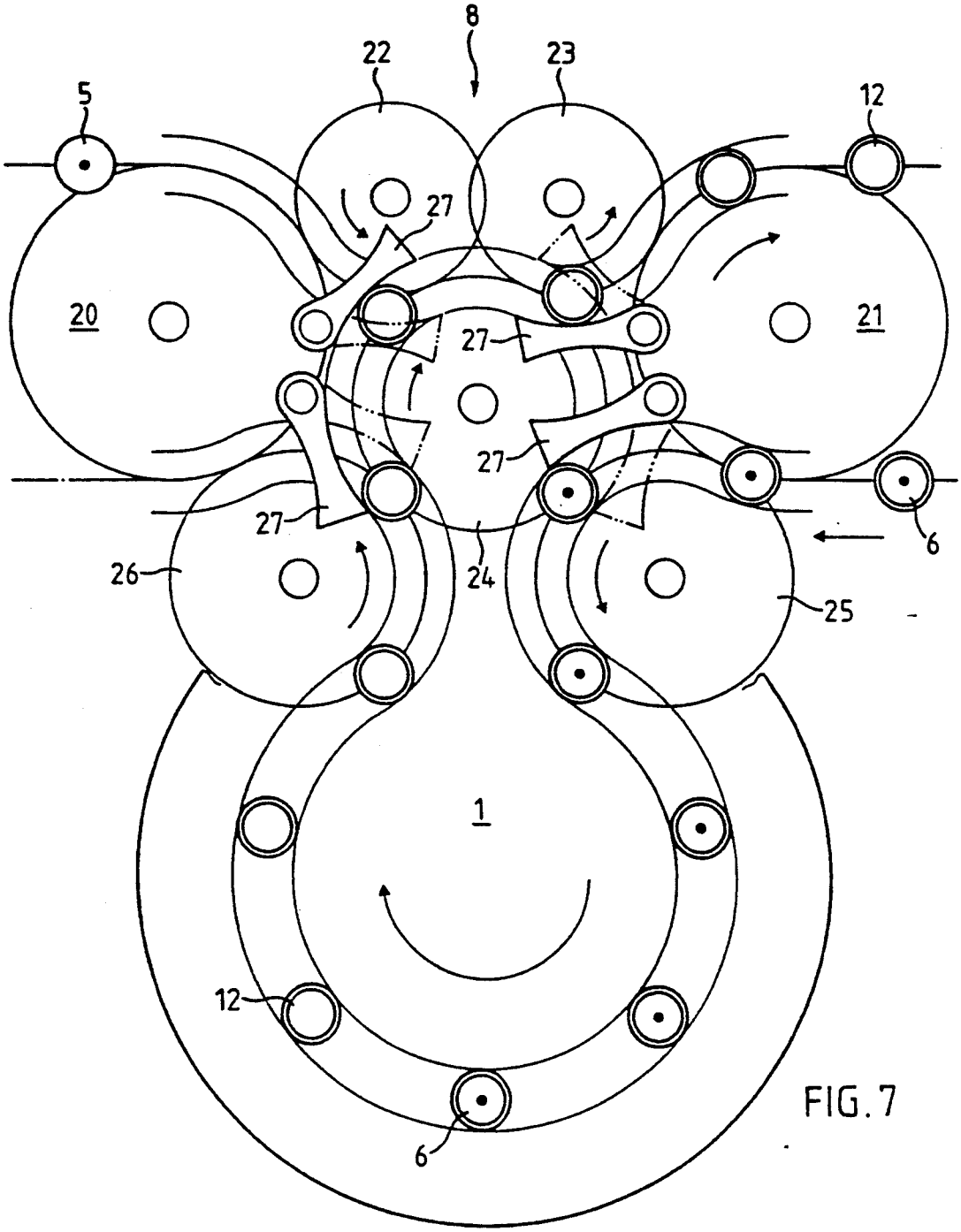
FIG. 7 depicts the guiding of ammunition and the position of the guide devices during firing cartridges of another type of ammunition, conveniently referred to as ammunition type B.

Regarding the portrayal of the infeed of cartridges or ammunition rounds 6 of the ammunition type B in the event such should be fired, attention is directed to FIG. 7.

Figure 3:
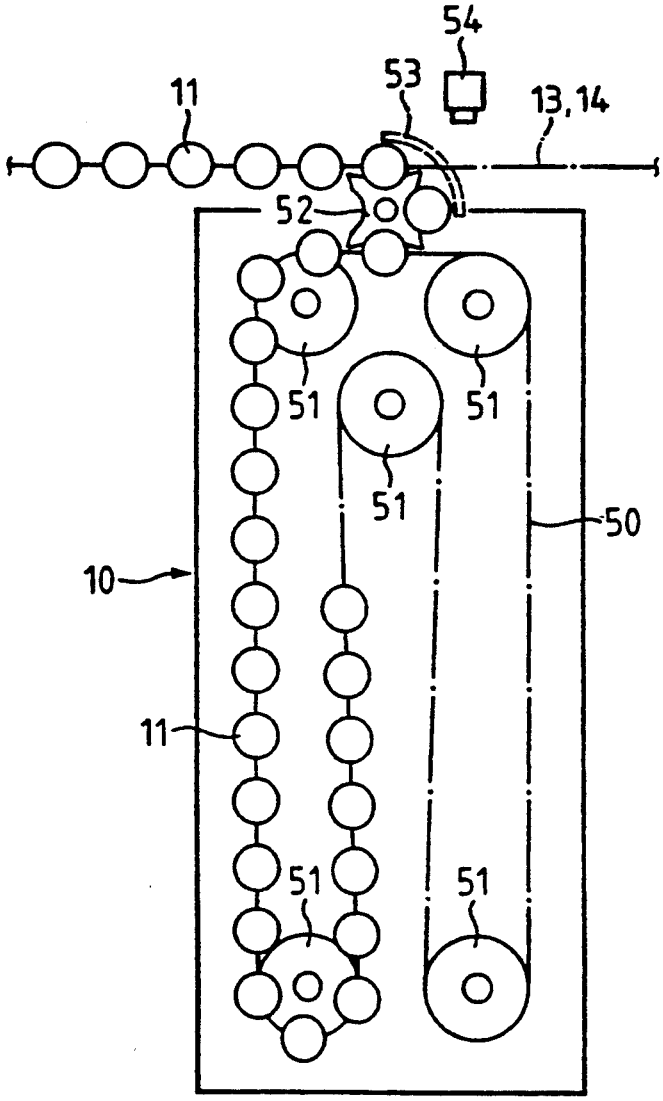
FIG. 3 is a fragmentary and enlarged detail view of a further part of the double or twin ammunition infeeding apparatus of FIG. 1.

FIG. 3 illustrates one of the two storage devices 10 which, as will be recalled from the prior discussion, are respectively operatively associated with the first endless transport device 3 and the second endless transport device 4. Although the following description conveniently relates to the first endless transport device 3 it is to be expressly understood such is analogously applicable to the second endless transport device 4. In the depicted arrangement the storage device 10 is portrayed in that position which it assumes prior to firing or releasing a new firing burst with cartridges or ammunition rounds 5 of the ammunition type A, that is, after reverse clearing or repositioning has taken place. In order to better explain the operation attention is directed to FIGS. 4a to 4d which will be more fully discussed shortly The storage device 10 likewise comprises a transport devioe 45 containing a bucket chain 50 which revolves or circulates upon transport wheels or sprockets 51 or the like. The drive of the storage device 10 has not been here particularly shown in order to simplify the illustration, however, can be accomplished in any suitable and usual manner as is well known to those skilled in this technology. The storage device is arranged in such a manner that during reverse clearing this storage device can receive, by means of a transfer star wheel or sprocket 52, empty cases or spent cartridges 11 from the first endless transport device 3. The reception of the empty cases or spent cartridges in the storage device 10 only occurs during reverse clearing and is controlled by a sensor or feeler 54 and a switching gate or switch 53.

During a firing burst, that is, during the forward travel of the Gatling-type gun the empty cases or spent cartridges 11 are then again ejected out of the storage device 10 and via the transfer star wheel 52 again transferred to the first endless transport device 3 which, in turn, again transports such empty cases o spent cartridges 11 back to the associated ammunition magazine, here the ammunition magazine 70. Since sensors or feelers which can detect when there has been completed a reverse clearing operation, namely, exactly then when the forwardmost or lead cartridge or ammunition round 5 has again assumed the position depicted in FIG. 4*a*, are well known to those skilled in this technology such have not been here further shown.

FIGS. 4*a*, 4*b*, 4*c* and 4*d* depict the different phases of the function of the inventive double or twin ammunition infeeding apparatus during a firing burst with cartridges or ammunition rounds 5 of the ammunition type A. The following discussion is analogously applicable to firing bursts performed with cartridges or ammunition rounds 6 of ammunition type B, which explains why such corresponding operating phases have not been particularly illustrated.

FIG. 4*a* schematically depicts the situation which is designated as the firing preparatory position. Such occurs when there has been completed the reverse clearing operation. Cartridges or ammunition rounds 5 of the ammunition type A are located upon the first endless transport device 3. The forwardmost or lead cartridge 5, in other words, that cartridge or ammunition round which is initially fired during the next following firing burst, is already located at the transport wheel 20. In this position there has been stopped the reverse clearing operation after the last firing burst. In this case there are likewise located at the first endless transport device 3, but also in the storage device 10, empty cases or spent cartridges 11 of the ammunition type A. Such have been transferred to the storage device 10 during the reverse clearing operation. In this position the Gatling-type gun 1 is ready to perform a firing burst with cartridges or ammunition rounds 5 or with cartridges or ammunition rounds 6 of the ammunition type A or ammunition type B, respectively.

FIG. 4*b* schematically depicts the situation which arises shortly after the start of a firing burst with cartridges or ammunition rounds 5 of ammunition type A. Cartridges 5 of ammunition type A are transferred from the first endless transport device 3 to the third device 8 which, in turn, transfers such cartridges 5 to the Gatling-type gun 1. The cartridges or ammunition rounds 5 are continuously fired and the empty cases or spent cartridges 11 are transported back to the first endless transport device 3 by means of the Gatling-type gun 1 and the third device 8. The first endless transport device 3 transfers these empty cases or spent cartridges 11 into the ammunition magazine 70. With the start of the forward movement of the first endless transport device 3, the third device 8 and the Gatling-type gun 1, also the storage device 10 has been placed in motion and has started to transport back via the transfer star wheel 52 to the first endless transport device 3 the empty cases or spent cartridges which have been intermediately stored thereat during the last reverse clearing operation. Since during the last reverse clearing operation there have been intermediately stored at the storage device 10 exactly as many empty cases or spent cartridges 11 a have found space during the return path or motion, there are thus no longer present any empty places or positions at the first endless transport device 3.

FIG. 4*c* schematically depicts the situation which arises after the termination of a firing burst with cartridges or ammunition rounds 5 of the ammunition type A and after the timewise shifted standstill of the installation. After firing the last cartridge 5 of the firing burst the devices 3, 8, 1, and 10 do not immediately come to standstill, rather are braked or decelerated during a certain time interval. As a result, cartridges or ammunition rounds 5 of the ammunition type A which have not been fired are further transported by the Gatling-type 10 gun 1 and again transferred to the first endless transport device 3. At the first endless transport device 3 such non-fired cartridges 5 are further transported up to a location which is situated directly in front of the transfer star wheel 52 of the storage device 10. The run-out operation or deceleration is thus stopped exactly then when the sensor or feeler 54 detects the first cartridge or ammunition round 5 which has not been fired. Thereafter, upon standstill of the installation there is switched the switching gate or switch 53 of the storage device 10.

FIG. 4*d* schematically depicts the situation which arises shortly after the start of a reverse clearing operation. Upon standstill of the installation there has been switched the switching gate or switch 53 of the storage device 10, so that during the reverse clearing operation it transfers empty cases or spent cartridges 11 to the storage device 10. During the reverse clearing operation the first endless transport device 3, the third device 8, the Gatling-type gun 1 and the storage device 10 are moved in the opposite direction or travel sense. As a result, the cartridges or ammunition rounds 5 are transported back in the direction of the ammunition magazine 70. The empty cases or spent cartridges 11 of the ammunition type A are thus no longer transported back by the Gatling-type gun 1 and the third device 8, rather delivered into the storage device 10. The reverse clearing operation is then completed when the Gatling-type gun and the third device 8 are devoid of non-fired cartridges or ammunition rounds 5 of the ammunition type A. This situation is present when there has been again attained the position depicted in FIG. 4a. This final position or firing preparatory position is detected by the previously mentioned although not particularly depicted further sensor or feeler. Thereafter, also the switching gate or switch 53 has been again switched back into its original position.

Figure 5:
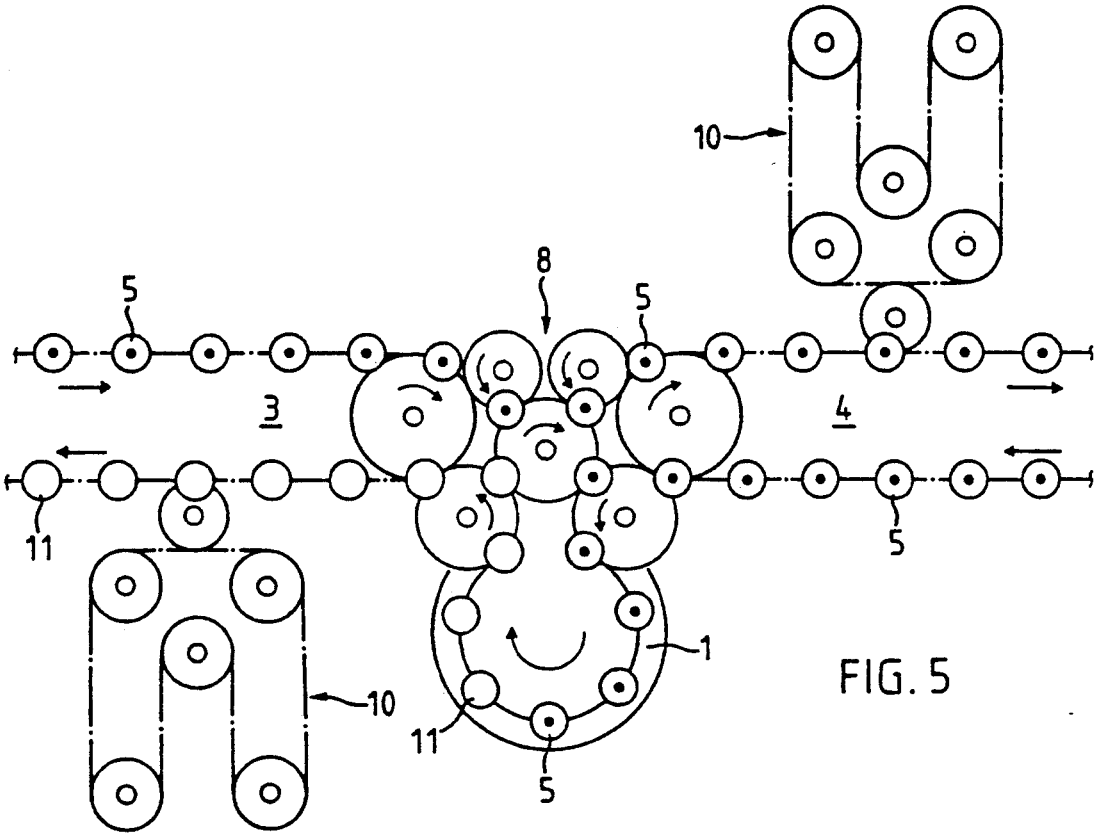
FIG. 5 depicts the function of the inventive double or twin ammunition infeeding apparatus during firing with only one type of ammunition delivered from two ammunition magazines.

FIG. 5 schematically depicts the function of the inventive double or twin ammunition infeeding apparatus during a firing mode using only one type of ammunition delivered from two ammunition magazines. Also in this case it is assumed that firing is accomplished with cartridges or ammunition rounds 5 of the ammunition type A. In this example there have not been illustrated the ammunition magazines out of which there are conveyed the cartridges or ammunition rounds 5, but such may be like the ammunition magazines 70 and 80 shown in FIG. 1. A notable advantage of this mode of operation resides in the fact that there can be fired cartridges or ammunition rounds from both ammunition magazines without the need to change an ammunition magazine.

Basically during this mode of operation the not particularly illustrated ammunition magazines, operatively associated with both the first and second endless transport device 3 and 4, the third device 8 and the Gatling-type gun 1 are connected together to form an ammunition loop. Thus, cartridges or ammunition rounds 5 are first transported out of one of the non-illustrated ammunition magazines by means of the first endless transport device 3 and via the third device 8 and the second endless transport device 4 are delivered into the other non-illustrated ammunition magazine. Since both ammunition magazines themselves are constituted by endless transport devices, the first ammunition magazine thus first of all replaces the cartridge consumption or depletion which has occurred at the other ammunition magazine. Cartridges or ammunition rounds 5 thus again arrive at the second endless transport device 4 and from that location are delivered by the third device 8 to the Gatling-type gun 1 and there fired. Empty cases or spent cartridges 11 are then again conveyed by means of the third device 8 to the first endless transport device 3 and from that location are transported back into the ammunition magazine.

During this operating mode there is only used one of both storage devices 10. Just as was the case for the other operating modes, here too the storage device 10 prevents that during reverse clearing empty cases or spent cartridges 11 will be transported by the Gatling-type gun 1 and the third device 8. Thus, also in this case it is ensured that the first fired round of a firing burst will take place after running up to speed of the Gatling-type gun 1 and that there are only delivered empty cases or spent cartridges 11 into the ammunition magazines.

In order to be able to operate all of the inventive double or twin ammunition infeeding apparatuses throughout the heretofore discussed different operating modes, there are required the use of guide devices 27 which correctly convey the cartridges or ammunition rounds 5 and 6 and the empty cases or spent cartridges 11 and 12 into the third device 8. These guide devices 27 and their corresponding positions have been more fully depicted in FIGS. 6, 7 and 8 and will be further considered with reference thereto.

Figure 6:
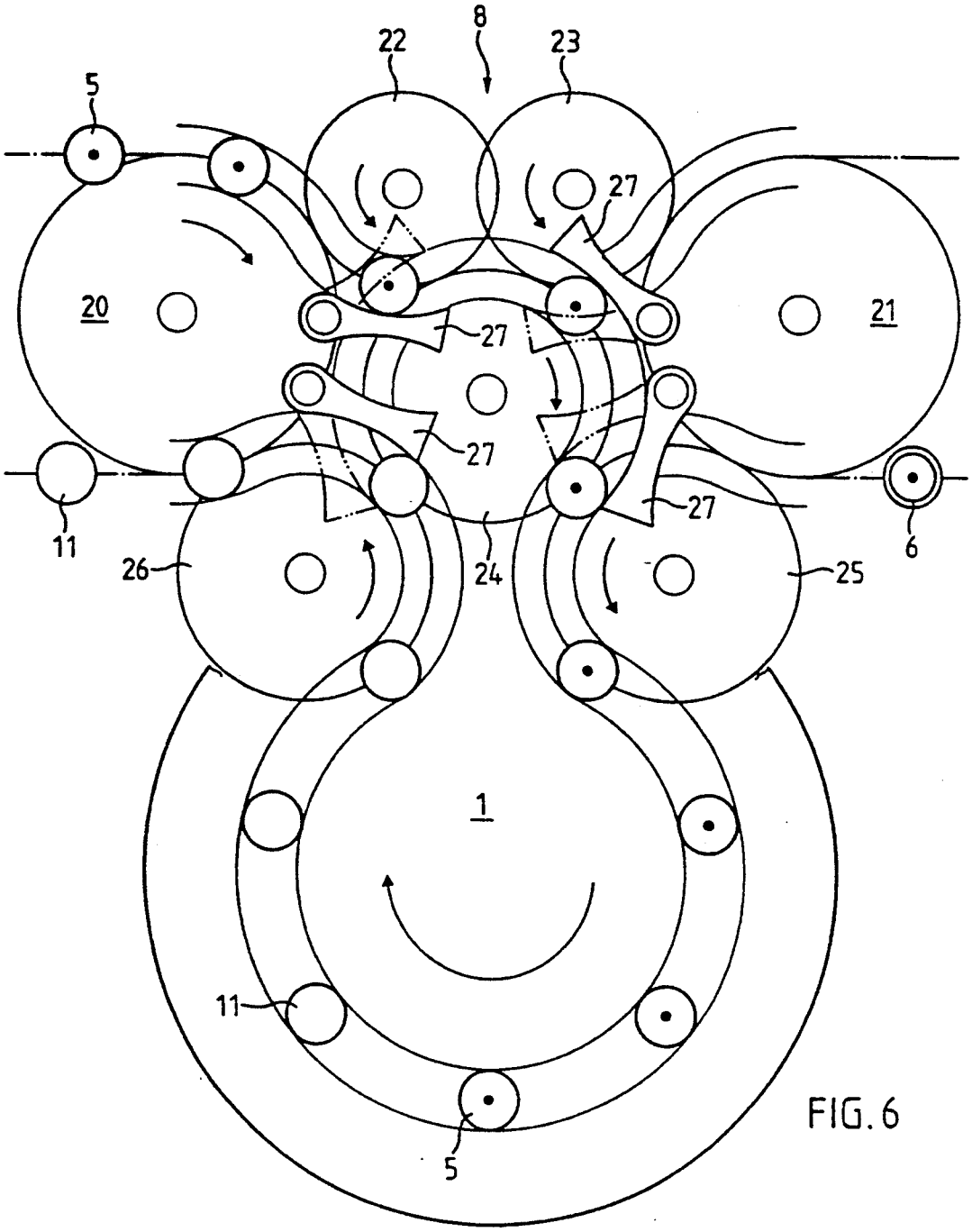
FIG. 6 depicts the guiding of ammunition and the position of the guide devices during firing cartridges of one type of ammunition, conveniently referred to as ammunition type A.

FIG. 6 schematically depicts the guiding of ammunition and the position of the guide devices 27 during firing cartridges 5 of ammunition type A. There are also depicted in such FIG. 6 the directions of rotation of the deflection or turning wheels 22, 23, 25 and 26 and the central deflection or turning wheel 24.

FIG. 7 schematically depicts the guiding of ammunition and the position of the guide devices 27 during firing cartridges 6 of the ammunition type B. From this FIG. 7 there also will be apparent that the directions of rotation of the deflection or turning wheels 22, 23, 25 and 26 and the central deflection or turning wheel 24 are the same as during firing cartridges or ammunition rounds 5 of the ammunition type A.

The guide devices 27 are interconnected with one another by not particularly illustrated mechanical control elements in such a manner that the first transported cartridge or ammunition round 5 of the ammunition type A can automatically control the guide devices 27 to assume the position shown in FIG. 6. Equally, the first transported cartridge or ammunition round 6 of the ammunition type B can control the guide devices 27 automatically into the position of FIG. 7. This automatic mechanical control can be always then employed when cartridges or ammunition rounds 5 and 6 of two different types of ammunition are to be fired.

Figure 8:
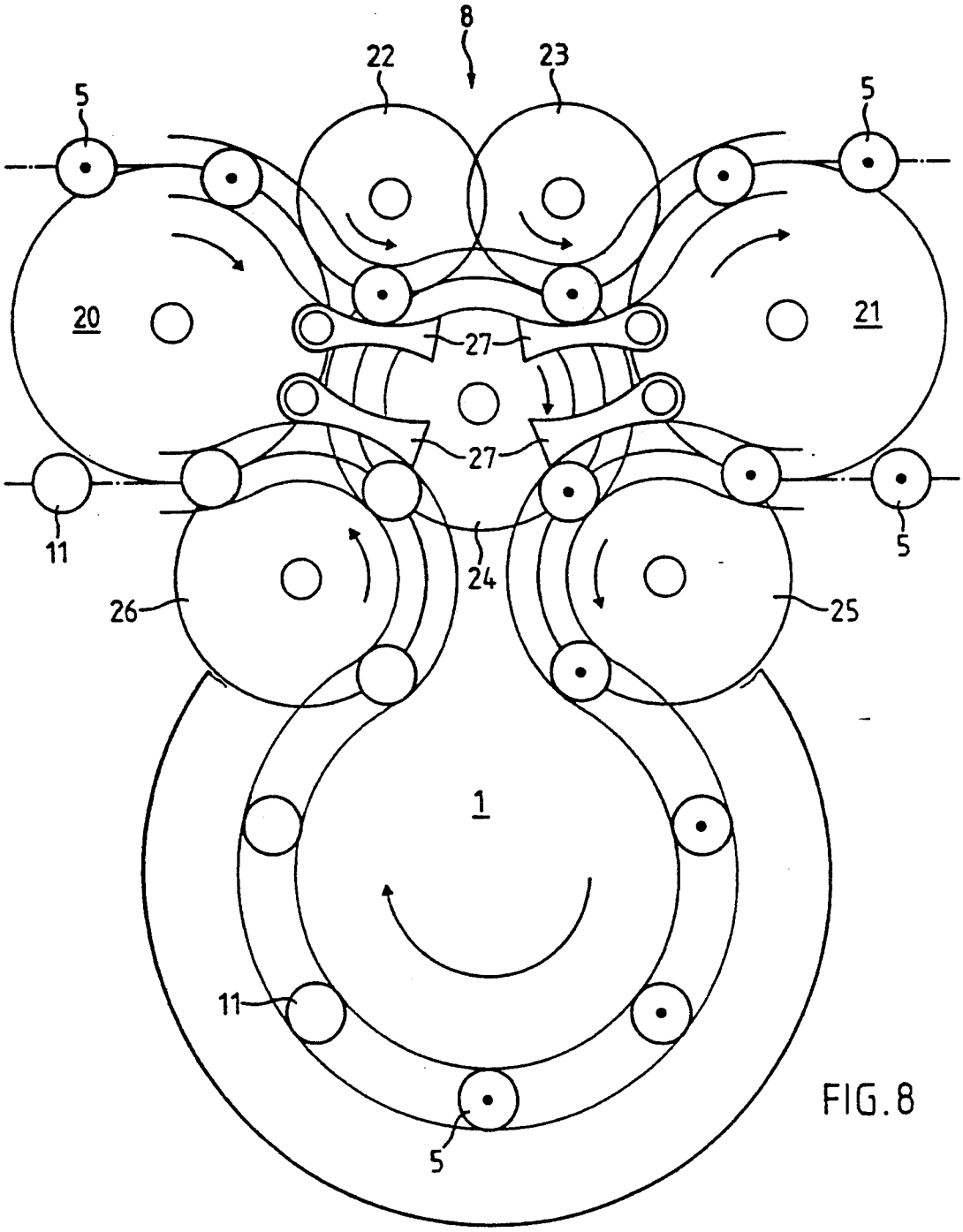
FIG. 8 depicts the guiding of ammunition and the position of the guide devices during firing cartridges of ammunition type A delivered from two ammunition magazines.

FIG. 8 schematically depicts the guiding of ammunition and the position of the guide devices 27 during firing cartridges or ammunition rounds 5 of ammunition type A delivered from two ammunition magazines. Also from this FIG. 8 there will be seen that the directions of rotation of the deflection or turning wheels 22, 23, 25 and 26, the central deflection or turning wheel 24 and the transport wheels 20 and 21, are the same as during firing cartridges or ammunition rounds 5 or 6 of the ammunition type A or B, respectively.

During firing of cartridges or ammunition rounds 5 of the ammunition type A from two ammunition magazines the guide devices 27 are brought by means of further not particularly illustrated mechanical control elements into the position depicted in FIG. 8. The previously considered automatic control, as was the case when firing cartridges 5 and 6 of two different ammunition types A and B, can not be here employed.

In the described embodiments the storage devices 10 are provided in the form of endless transport devices. However, other constructions are conceivable, as, for example, also displacement magazines as the same are used with other automatic weapon systems, for instance, rapid firing guns.

While there are shown and described present preferred embodiments of the invention, it is distinctly to be understood the invention is not limited thereto, but may be otherwise variously embodied and practiced within the scope of the following claims.

What is claimed is:

1. An apparatus for the infeed of cartridges predominantly composed of two different types of ammunition to a Gatling-type gun, comprising:

a first transport device for the transport of cartridges and empty cases of predominantly a first type of ammunition;

a second transport device for the transport of cartridges and empty cases of predominantly a second type of ammunition;

a third device arranged between the first transport device and the second transport device and located for cooperation with the Gatling-type gun for infeeding the cartridges of the first ammunition type or the second ammunition type to the Gatling-type gun;

a coupling device for selectively coupling either the first transport device or the second transport device with the third device;

the first transport device and the second transport device are stationarily arranged relative to the third device;

a respective storage device operatively associated with the first transport device and the second transport device for receiving empty cases from the first transport device and the second transport device during reverse clearing following a firing burst, in order to ensure that prior to a new firing burst both the Gatling-type gun and the third device are devoid of empty cases.

2. The apparatus for the infeed of cartridges according to claim 1, further including:

a respective sensor and a respective switching gate operatively associated with each of the storage devices so that during reverse clearing the empty cases are delivered to the associated storage device.

3. The apparatus for the infeed of cartridges according to claim 1, wherein:

each said first transport device and said second transport device comprise a respective endless transport device.

* * * * *